United States Patent [19]

Gruner

[11] Patent Number: 4,813,131

[45] Date of Patent: Mar. 21, 1989

[54] RETRACTABLE BLADE SAFETY RAZOR

[75] Inventor: George P. Gruner, Andover, Mass.

[73] Assignee: The Gillette Company, Boston, Mass.

[21] Appl. No.: 121,085

[22] Filed: Nov. 16, 1987

[51] Int. Cl.[4] ..... B26B 21/00

[52] U.S. Cl. ..... 30/50; 30/63; 30/79

[58] Field of Search ..... 30/50, 63, 77, 74.1, 30/79, 84

[56] References Cited

U.S. PATENT DOCUMENTS 3,657,811 4/1972 Nissen et al. ..... 30/63 X 4,501,067 2/1985 Duncan ..... 30/77 X

*Primary Examiner*—Douglas D. Watts

*Attorney, Agent, or Firm*—Owen J. Meegan; Aubrey C. Brine; Scott R. Foster

[57] ABSTRACT

A safety razor comprises a pivotal cap member which in a first position is effective to obscure the cutting edge of the blade or blade members to protect the cutting edge from contact with other objects. The cap member when pivoted to a second position exposes the blade cutting edge and positions a skin engaging guard surface adjacent the blade cutting edge to provide a desired shaving geometry.

15 Claims, 4 Drawing Sheets

RETRACTABLE BLADE SAFETY RAZOR

BACKGROUND OF THE INVENTION

The present invention is directed to safety razors and more particularly to a safety razor of the disposable type wherein the blade or blades are retractable when the razor is not in use.

Among the various shaving systems to be found on the market, the disposable safety razor has achieved a great deal of consumer acceptance in view of its compact construction and light weight allowing for ease of carrying, ease of use, and relative economy to the purchaser.

Many of the disposable razors of this type are provided with removable covers or caps which are effective to conceal the cutting edge of the blade, or blades, to both protect the blade from damage and to prevent damage to articles which might contact the blade when the razor is carried with other toiletry items. In general, these caps are fitted to the razor head by connector means providing a snap action or sliding action for removal or assembly onto the razor head, and are separable items which are removed from the razor head. These caps or covers often become detached from the razor head and may become lost prior to use of the razor. In addition, many of the disposable razors are of a quality which permits more than a single use of the razor, and the cap may be lost or misplaced after being removed from the razor, thereby eliminating its usefulness for transporting the razor. Since these caps or covers have generally been of a bulky construction, it has proven difficult to incorporate them into the safety razor assembly without increasing the size and weight of the assembly which would eliminate one of the basic features of the disposable razor.

It is therefore an object of the present invention to provide a safety razor assembly having a rectractable blade which assembly is compact and simple in construction.

A further object of the invention is to provide a safety razor assembly wherein a pivotable cap produces the effect of retracting the cutting edge of the razor blade during non-use and is effective to expose the cutting edge of the razor blade during use.

Yet another object of the invention is to provide a safety razor assembly wherein the cutting edge of the razor blade is retracted or extended by a simple manipulation by the thumb of the user while the razor assembly is held in the hand.

Another object of the invention is to provide a safety razor assembly wherein the cap or cover element of the assembly becomes an integral operating element during the shaving process.

SUMMARY OF THE INVENTION

The aforementioned objects and other objectives which will become apparent as the description proceeds are accomplished by providing a safety razor assembly comprising a handle having a shaving head disposed at the upper end thereof wherein the shaving head comprises a blade holder having blade means mounted therein with a cutting edge extending forwardly from the blade holder. The assembly further provides wall structure forming a cap having a top wall with an elongated opening formed therein and a guard surface formed on the outer surface of the top wall adjacent the opening. Pivotal means is provided interconnecting the cap with the shaving head for movement of the cap from a first position wherein the wall structure substantially obscures the blade means cutting edge, to a second position wherein the elongated opening is positioned to expose the blade means cutting edge with the guard surface exposed adjacent the blade means cutting edge to provide a predetermined shaving geometry.

In a more detailed sense, the pivotal means comprises a cylindrical boss disposed below the shaving head and the cap comprises a downwardly and rearwardly extending lip having a concave cylindrical surface for interfitting engagement with the boss. The wall structure may further comprise a rear wall having a downwardly extending flange with a substantially forward facing limit stop surface formed thereon and a substantially rearward facing surface disposed on the head contacts the limit stop surface with the cap in a first position. The top wall may further comprise a substantially downwardly facing limit stop surface formed thereon and a substantially upwardly facing surface disposed on the head is aligned to contact the limit stop surface with the cap in the second position.

A cam surface may be formed on the head extending rearwardly from the rearward facing surface and contacting the downwardly extending flange during movement of the cap between the first position and the second position.

BRIEF DESCRIPTION OF THE DRAWING

The foregoing and other features of the invention will be more particularly described in connection with the preferred embodiment, and with reference to the accompanying drawing, wherein.

DESCRIPTION OF THE PREFERRED EMBODIMENT

Figure 1:
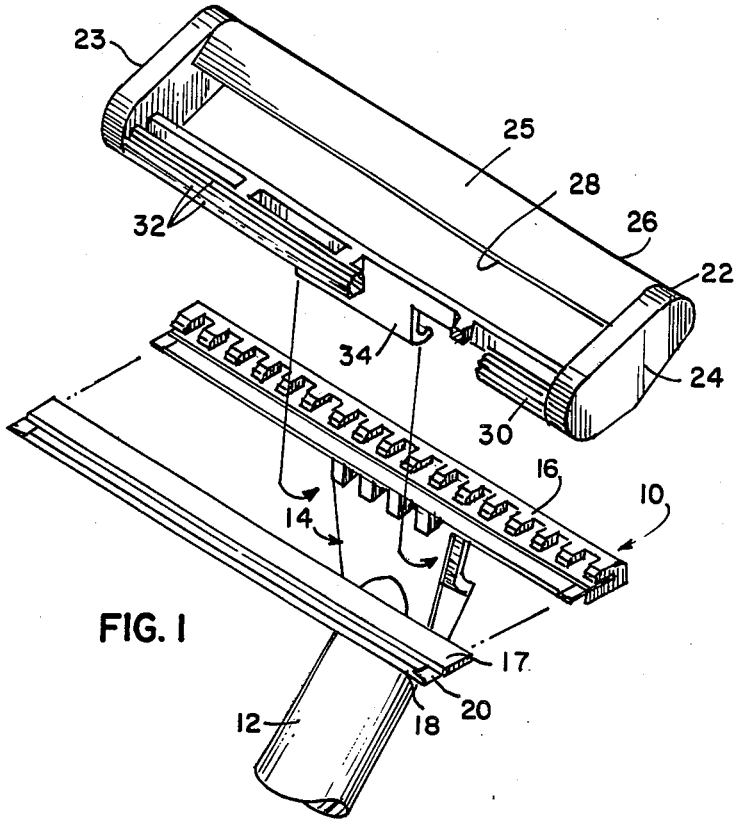
FIG. 1 is an exploded perspective view, partially in section, showing the basic elements of a safety razor constructed in accordance with the teachings of the present invention.
Figure 2:
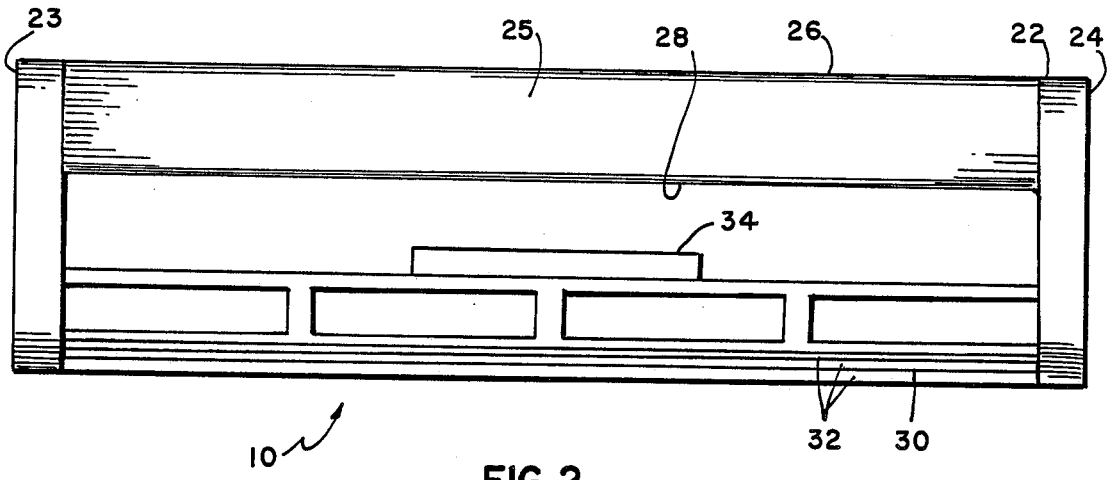
FIG. 2 is a top plan view showing details of the pivotal element of FIG. 1.
Figure 3:
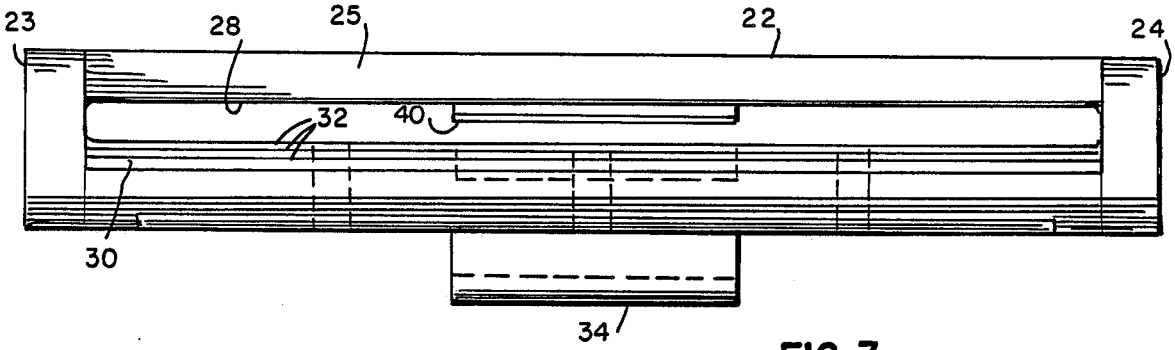
FIG. 3 is a front elevational view showing further details of the pivotal element of FIGS. 1 and 2.
Figure 4:
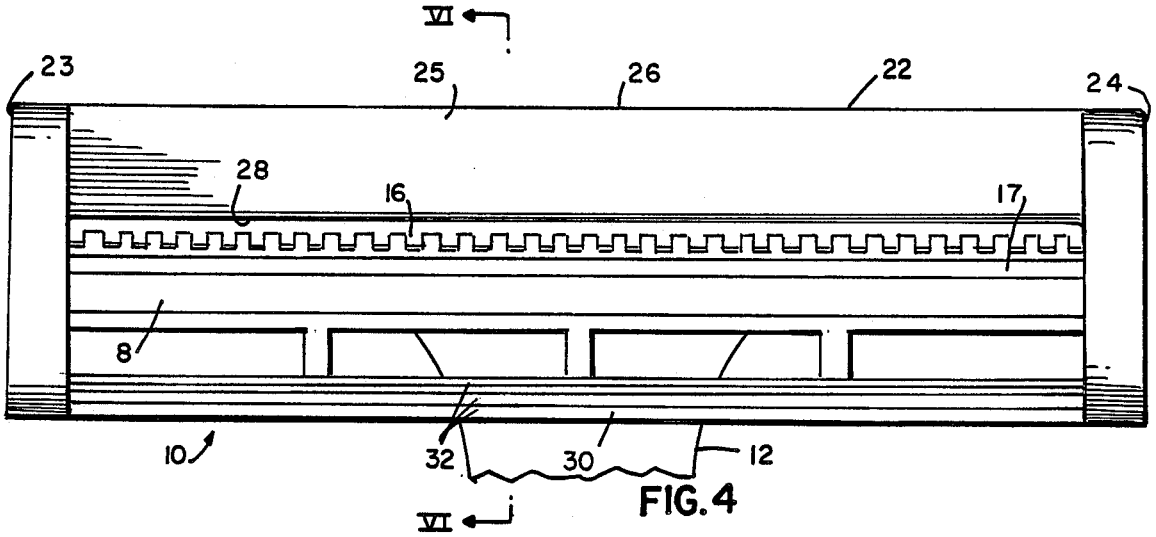
FIG. 4 is a top plan view showing the safety razor assembly of FIG. 1 in the shaving mode.

Referring now to the drawing and in particular to FIGS. 1 through 8, there is shown a safety razor assembly 10 constructed in accordance with the teachings of the present invention and comprising a handle 12 having a shaving head 14 disposed at the upper end thereof.

The head 14 comprises a blade holder 16 having a groove into which a pair of blades 17 and 18 are mounted in parallel staggered spaced relation with a spacer 20 disposed therebetween.

The safety razor assembly 10 further comprises wall structure forming a cap 22 having a pair of side walls 23 and 24, a top wall 25 and a rear wall 26. The top wall 25 has an elongated opening 28 formed therein which extends from the side wall 23 to the side wall 24. A guard surface 30 is disposed adjacent the elongated opening 28 and is formed on the top wall 25 of the cap 22. The guard surface 30 is provided witha plurality of grooves 32 disposed parallel to the elongated opening 28 and is oriented on the cap 22 for applying pressure to the skin of the user ahead of the blades 17 and 18 during the shaving process, which technique is well known in the art.

Figure 5:
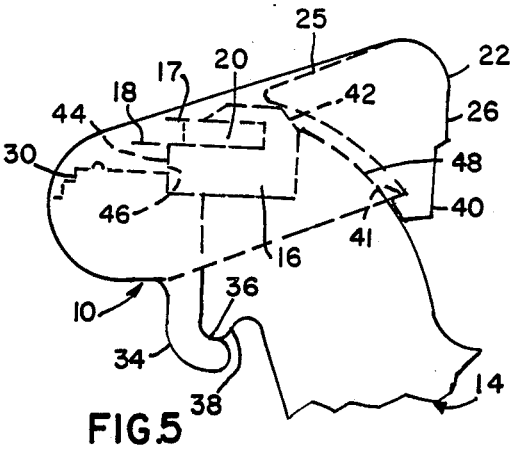
FIG. 5 is a left side elevational view showing details of the assembly of FIG. 4.
Figure 6:
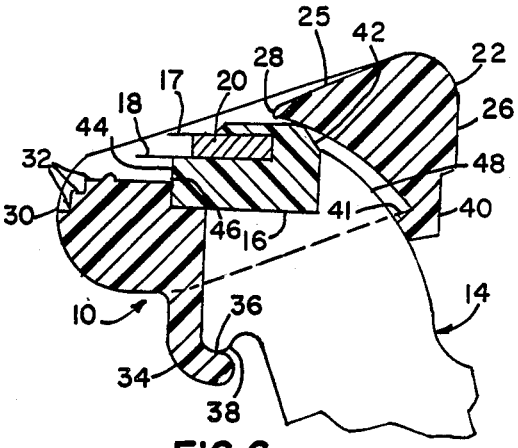
FIG. 6 is an elevational sectional view taken along the line VI—VI of FIG. 4 showing further details of the assembly of FIGS. 4 and 5.
Figure 7:
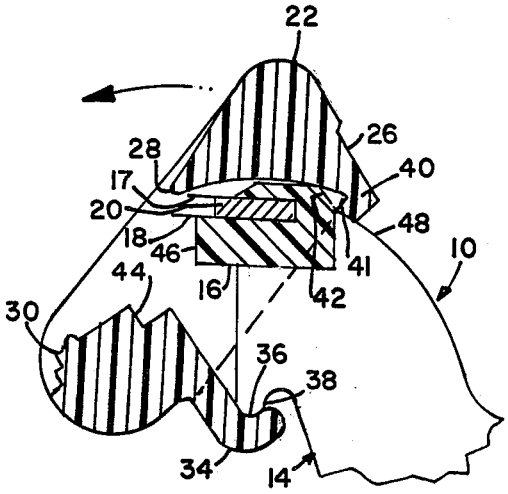
FIG. 7 is an elevational sectional view similar to FIG. 6 and taken at the sectional line VI—VI, but showing the safety razor assembly of FIG. 4 in the safety mode.

As best shown in FIGS. 5, 6 and 7, the cap 22 is provided with a pivotal means in the form of a downwardly and rearwardly extending lip 34 having a concave cylindrical surface 36 formed thereon which is dimensioned for interfitting engagement with a cylindrical boss 38 disposed on the lower surface of the head 14.

The rear wall 26 of the cap 22 has a downwardly extending flange 40 with a substantially forward facing limit stop surface 41 formed thereon. A complimentary rearward facing surface 42 is formed on the head 14 for contacting the limit stop surface with the cap 22 in the forward position as shown in FIG. 7. The top wall 25 of the cap 22 comprises a substantially rearwardly facing limit stop surface 44 and a substantially forwardly facing surface 46 is disposed on the shaving head 14 for contacting the limit stop surface 44 when the cap 22 is in the second position as shown in FIG. 6. The shaving head 14 further is provided with a radial cam surface 48 which is constructed such that the flange 40 contacts the cam surface 48 during movement between the first position and the second position maintaining the concave surface 36 in contact with the lip 34 during movement of the cap 22 between the two positions.

Figure 8:
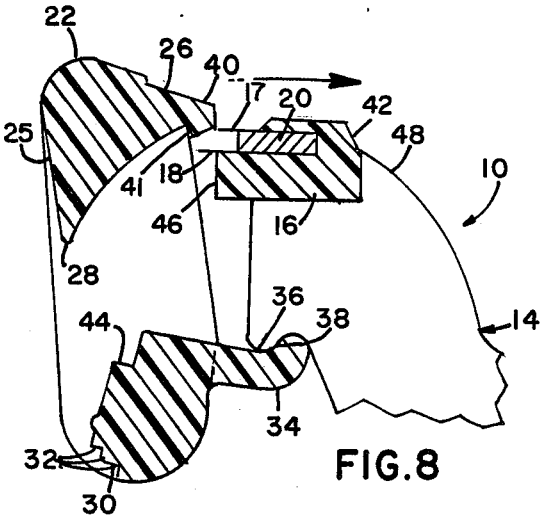
FIG. 8 is an elevational sectional view similar to FIGS. 6 and 7 taken at the section line VI—VI, but showing a stage of assembly of the structure of FIGS. 4 through 7.

Referring now to FIG. 8, the method of assembly of the cap 22 onto the other elements of the shaving head assembly 14 is shown to be simply accomplished by placing the lip 34 over the boss 38 and forcing the flange 40 over the surfaces 42 and 46 of the head assembly. Ease of assembly is facilitated by forming the cap 22 from a resilient plastic material. In the preferred embodiment, the cap 22 is formed of a polystyrene material although materials having like qualities of resiliency may be chosen to achieve the simple assembly, as described above.

Figure 9:
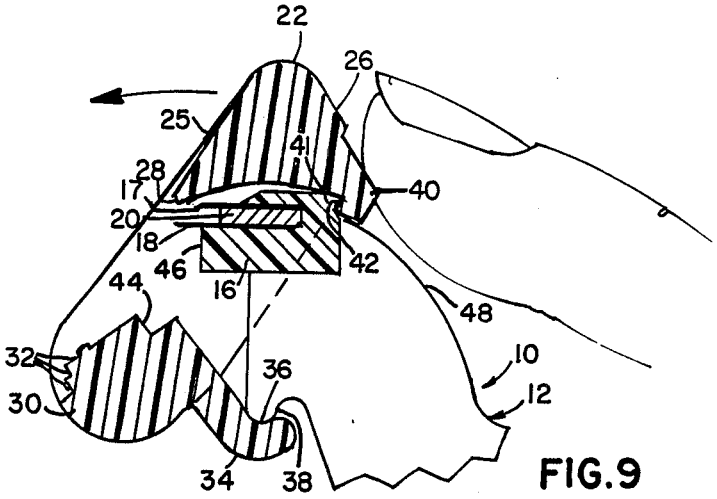
FIGS. 9 and 10 are side elevational views, partially in section, showing operation of the safety razor assembly constructed in accordance with the herein disclosed invention.
Figure 10:
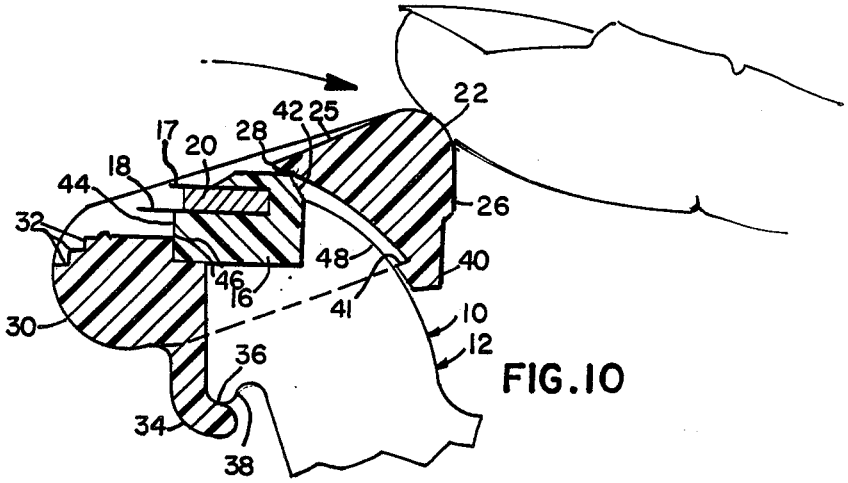

Referring now to FIGS. 9 and 10, in FIG. 9, the cap 22 is shown in its forward most position with the rearwardly facing surface 42 of the shaving head in contact with the limit stop surface 41 of the cap 22, and the top wall 25 of the cap effective to cover the cutting edges of the blades 17 and 18. In this mode, the safety razor may be stored or transported without the possibility of the blades 17 and 18 damaging adjacent articles or being damaged themselves by contact with other objects.

By simply holding the safety razor 10 in one hand, the thumb may be used to rotate the cap 22 to the position shown in FIG. 10 wherein the downwardly facing limit stop surface 44 on the cap 22 contacts the upwardly facing surface 46 of the head and the blades 17 and 18 are exposed for shaving. It should be noted that in this second position, the guard surface 30 has been so located on cap 22 to provide proper spacing from the edges of the blades 17 and 18 to provide a shaving geometry which has been predetermined to allow the safety razor assembly 10 to function properly.

From the foregoing therefore, it is evident that the present invention provides a safety razor assembly which is compact and simple is construction and which is an improvement over safety razor constructions to be found in the prior art.

I claim:

1. A safety razor assembly comprising:

a handle having a shaving head disposed at the upper end thereof, said shaving head comprising a blade holder having blade means mounted therein with a cutting edge extending forwardly from said blade holder;

wall structure forming a cap having a top wall with an elongated opening formed therein and a guard surface formed on the outer surface of said top wall adjacent said opening, and pivotal means interconnecting said cap with said shaving head for movement of said cap from a first position wherein said wall structure substantially obscures said blade means cutting edge to a second position wherein said elongated opening is positioned to expose said blade means cutting edge with said guard surface disposed adjacent said blade means cutting edge to provide a predetermined shaving geometry, said pivotal means comprising a cylindrical boss disposed below said shaving head and said cap comprising a downwardly and rearwardly extending lip having a concave cylindrical surface for interfitting engagement with said boss.

2. A safety razor assembly comprising:

a handle having a shaving head disposed at the upper end thereof, said shaving head comprising a blade holder having blade means mounted therein with a cutting edge extending forwardly from said blade holder;

wall structure forming a cap having a top wall with an elongated opening formed therein and a guard surface formed on the outer surface of said top wall adjacent said opening, pivotal means interconnecting said cap with said shaving head for movement of said cap from a first position wherein said wall structure substantially obscures said blade means cutting edge to a second position wherein said elongated opening is positioned to expose said blade means cutting edge with said guard surface disposed adjacent said blade means cutting edge to provide a predetermined shaving geometry, said wall structure further comprising a rear wall having a downwardly extending flange with a substantially forward facing limit stop surface formed thereon and a substantially rearward facing surface disposed on said head for contacting said limit stop surface with said cap in said first position.

3. A safety razor assembly as set forth in claim 1 wherein said top wall comprises a substantially rearwardly facing limit stop surface formed thereon and a substantially forwardly facing surface disposed on said head for contacting said limit stop surface with said cap in said second position.

4. A safety razor assembly as set forth in claim 2 wherein said head comprises a cam surface formed thereon extending rearwardly from said rearward facing surface and contacting said downwardly extending flange during movement of said cap between said first position and said second position.

5. A safety razor assembly as set forth in claim 1 wherein said blade means comprises a pair of blades disposed in parallel, staggered spaced relation with a spacer member therebetween.

6. A safety razor assembly as set forth in claim 1 wherein said guard surface has formed therein a plurality of grooves disposed parallel to said elongated opening.

7. A safety razor assembly as set forth in claim 1 wherein said cap is formed of a resilient plastic material.

8. A safety razor assembly as set forth in claim 1 wherein said cap is formed of polystyrene material.

9. A safety razor assembly as set forth in claim 1 wherein said wall structure comprise a rear wall having downwardly extending flange with a substantially forward facing limit stop surface formed thereon and a substantially rearward facing surface is disposed on said head for contacting said limit stop surface with said cap in said first position.

10. A safety razor assembly as set forth in claim 9 wherein said top wall comprises a substantially rearwardly facing second limit stop surface formed thereon and a substantially forwardly facing surface is disposed on said head for contacting said second limit stop surface with said cap in said second position.

11. A safety razor assembly as set forth in claim 10 wherein said head comprises a cam surface formed thereon extending rearwardly from said rearward facing surface and contacting said downwardly extending flange during movement of said cap between said first position and said second position.

12. A safety razor assembly as set forth in claim 11 wherein said guard blade means comprises a pair of blades disposed in parallel, staggered spaced relation with a spacer member therebetween.

13. A safety razor assembly as set forth in claim 12 wherein said guard surface has formed therein a plurality of grooves disposed parallel to said elongated opening.

14. A safety razor assembly as set forth in claim 13 wherein said cap is formed of a resilient plastic material.

15. A safety razor assembly as set forth in claim 14 wherein said resilient plastic material is polystyrene.

* * * * *